US006465099B1

(12) United States Patent
Yamane et al.

(10) Patent No.: US 6,465,099 B1
(45) Date of Patent: Oct. 15, 2002

(54) VINYL CHLORIDE FIBER AND PROCESS OF PRODUCING THE SAME

(75) Inventors: Kazumasa Yamane, Kagogawa; Hiroshi Yokoyama, Akashi; Yuji Kubo, Kakogawa; Ikuo Okino, Kobe, all of (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/871,824

(22) Filed: Jun. 4, 2001

Related U.S. Application Data

(63) Continuation of application No. 09/180,383, filed on Nov. 6, 1998.

(30) Foreign Application Priority Data

Mar. 11, 1997 (JP) ..... 9-056624
Jul. 31, 1997 (JP) ..... 9-206414

(51) Int. Cl.[7] ..... D02G 3/00
(52) U.S. Cl. ..... 428/401; 524/524; 524/527
(58) Field of Search ..... 524/567, 524, 524/527; 428/401

(56) References Cited

U.S. PATENT DOCUMENTS 4,782,170 A * 11/1988 Bae et al. ..... 556/13
5,397,842 A * 3/1995 Hamilton et al. ..... 525/263
5,811,186 A 9/1998 Martin et al. ..... 428/373
6,274,238 B1 * 9/2001 DeLucia ..... 428/373

* cited by examiner

*Primary Examiner*—Peter D. Mulcahy
(74) *Attorney, Agent, or Firm*—Armstrong, Westerman & Hattori, LLP

(57) ABSTRACT

A process of producing a vinyl chloride fiber with a small fineness having seven-tenth to half of the full luster surface and feel remarkably similar to human hair is provided. The process provides the vinyl chloride fiber comprising a vinyl chloride resin composition obtained by formulating (a) 1–35 parts by weight of ethylene-vinyl acetate resin, (b) 0.2–5.0 parts by weight of thermal stabilizer, and (c) 0.2–5.0 parts by weight of lubricant to 100 parts of a vinyl chloride mixture consisting of 100–60% by weight of a vinyl chloride resin and 0–40% by weight of chlorinated vinyl chloride resin. The process also provides the vinyl chloride fiber obtained by melt spinning the resin composition described above. The vinyl chloride fiber is useful for an artificial hair fiber for the decoration of hair or a doll's hair fiber such as a doll hair.

10 Claims, No Drawings

VINYL CHLORIDE FIBER AND PROCESS OF PRODUCING THE SAME

This application is a continuation of U.S. application Ser. No. 09/180,383, filed Nov. 6, 1998.

BACKGROUND OF THE INVENTION

1. FIELD OF THE INVENTION

The present invention relates to a vinyl chloride fiber for use in artificial hair such as wigs, hairpieces, braid, extension-hair and accessory hair, or for use in fibers for dolls' hair such as doll-hair, and a process of producing the same.

2. Description of the Related Art

Vinyl chloride fibers produced by spinning vinyl chloride resins into fibers, on account of its superiority in strength, elongation, curl-keeping property and styling property, are much used in fibers for artificial hair for the decoration of hair or fibers for doll's hair such as doll-hair.

Hitherto, as fibers for artificial hair for the decoration of hair, in order to industrially produce fibers having a small degree of fineness (small cross-section and fine fibers), the wet spinning method that generally employs solvents for producing vinyl chloride resins or the dry spinning method is used. The wet-spinning method, however, has disadvantages that since solvents are used in the method with a result that a desolvating process is required, an excessive investment for installation is required, and the maintenance thereof needs many hands. In addition, in order to improve the solubility of the resins with solvent, copolymerization with a co-monomer such as acrylonitrile is carried out. As a result, there are problems that it is colored at an initial stage, it is liable to change to strong yellowish hair due to heat in a drying process, or it is not sufficient in the curl-keeping property for the fibers.

On the other hand, the melt spinning method is known as a spinning process in which no solvent is used. However, in order to obtain by this method fibers having a small fineness for artificial hair for the decoration of hair or the like and having a semi-gloss surface (evaluation standards thereof are shown in examples) and feel which are extremely similar to that of human hair, it is preferred that the resins are caused to melt and run-off through nozzle orifices the sectional areas of which are extremely small (0.5 $mm^2$ or less), thereby making a spinning draft ratio small (Dr ratio: 25 or less). In other words, adversely, if the resins are melt and run-off through nozzle orifices each having a larger sectional area to produce vinyl chloride fibers having a small fineness, the spinning draft ratio thereof is naturally required to be increased. As a result, undrawn filament results in being excessively drawn upon melt spinning. Therefore, the surface of the fiber (drawn filament) obtained by drawing and heating the undrawn fiber becomes smooth, has a luster, and lacks the dry feel. As a result, the product is prone to become fibers unsuitable for artificial hair fiber such as the hair decoration. Thus, in order to produce a high-quality fiber as the artificial hair fiber such as hair-decoration, melt and run-off is preferably conducted through the nozzle having the cross-section thereof as small as possible, so that the spinning draft ratio may become small.

However, there have conventionally been such problems that when a run-off is conducted through such a nozzle having an extremely small cross-section thereof, the pressure to the nozzles becomes larger than the designed pressure of an extruder, and when an extruding amount is set to be small so as to allow the pressure to be smaller than the rating, the productivity of melt spinning becomes low. Also, there was such a tendency that when the melt spinning temperature is set as high so as to reduce melting viscosity, thermal decomposition occurs and long-run property is decreased.

Accordingly, a wide variety of proposes for this process have so far been described in order to solve these problems, but have not solved completely. For example, Japanese Patent Publication No. Sho 51-2109 proposes to improve spinnability by using both vinyl chloride resin and methyl methacrylate resin. However, a fiber is drawn from a relatively large cross-section to a small section to obtain a fiber having a small fineness. As a result, the surface of the fiber becomes smooth thereby being liable to generate a luster, and resulting in imperfection as an artificial hair fiber because the fiber is not only still far from a semi-gloss surface like human hair, but also have no much dry feel. Additionally, in order to reduce melting viscosity of composition, the process in which Cd-Pb based thermal stabilizers comprising cadmium or lead and lubricants are used, is industrially carried out. However, the use of such formulation ingredients allows to solve difficulties in a nozzle pressure and productivity in melt spinning, while a coloring at an initial stage is intensive, and the product hair is prone to have a strong yellow tint. Further, because such formulation ingredients are very toxic, they are unfavorable either for production process or for a human safety and health due to a direct contact with human head skin as an accessory hair. Still further, this process raises the problem in which when disposed such the hair decorations get mixed in general garbage to cause environmental pollution.

SUMMARY OF THE INVENTION

A first object of the present invention is to provide a vinyl chloride fiber with a small fineness which, without using well-known Cd-Pd based thermal stabilizer or any lubricant, is remarkably improved in a at an initial stage, and which has not only semi-gloss surface-feel and flexibility just like human hair, but is excellent in strength, elongation and shrinkability. A second object of the present invention is to provide a vinyl chloride fiber with a small fineness, which can be produced in a safe and stable manner using the conventionally known Sn (tin) stabilizing agents, while improving their qualitative difficulties such as plastics feel, surface brilliance, the so-called stiffish fingering-touch and thermal shrinkability, and to provide a process of producing the same. A third object of the present invention is to provide a process of producing the vinyl chloride with a small fineness, which solves several difficulties occurred in melt spinning through a nozzle orifice having an extremely small sectional area, which allows to be well-balanced between a melt spinning productivity and a nozzle pressure, and which improve the level of the balance between the melt spinning temperature and the thermal decomposition and long-run property.

The inventors of the present invention have intensively studied on formulation systems of resin compositions, sectional areas of nozzles, melt spinning conditions and the like to solve the above-mentioned problems. Consequently, it was found out that when a vinyl chloride mixture comprising a vinyl chloride resin and a chlorinated vinyl chloride resin is added with an ethylene-vinyl acetate resin, a thermal stabilizer and a lubricant in the specific range, the fibers with a small fineness can be stably produced which, without using any Cd-Pb thermal stabilizer, lubricant and the like, has not only semi-gloss surface and a feel just like human hair, but solve the qualitative difficulties without lowering the melt spinning productivity, thus having achieved the present invention.

In other words, the present invention provides a vinyl chloride fiber comprising a vinyl chloride resin composition obtained by formulating (a) 1–35 parts by weight of ethylene-vinyl acetate resin, (b) 0.2–5.0 parts by weight of thermal stabilizer, and (c) 0.2–5.0 parts by weight of lubricant to 100 parts of a vinyl chloride mixture consisting of 100–60% by weight of a vinyl chloride resin and 0–40% by weight of chlorinated vinyl chloride resin. As the thermal stabilizer (b), at least one selected from the group consisting of tin- thermal stabilizers, Ca—Zn thermal stabilizers, hydrotalcite thermal stabilizers, and zeolite thermal stabilizers can be used. As the lubricant (c), at least one selected from the group consisting of a metallic soap lubricants containing no cadmium or lead, polyethylene lubricants, higher fatty acid lubricants, pentaerythritol lubricants, higher alcoholic lubricants, an d montanonic acid wax lubricants can be used Further, there may be used a vinyl chloride resin composition obtained by formulating (a) 1–35 parts by weight of an ethylene-vinyl acetate resin, (b) 0.2–5.0 parts by weight of at least one thermal stabilizer selected from the group consisting of tin mercapto- thermal stabilizers, tin maleate thermal stabilizers, and tin laurate thermal stabilizers, and (c) 0.2–5.0 parts by weight of at least one lubricant selected from the group consisting of metallic soap lubricants containing no cadmium or lead, polyethylene-lubricants, and pentaerythritol-lubricants to 100 parts by weight of vinyl chloride resin mixture consisting of 90–75% by weight of a vinyl chloride resin and 10–25% by weight of a chlorinated vinyl chloride resin. Still further, there may be also used a vinyl chloride resin composition obtained by formulating (a) 1–35 parts by weight of an ethylene-vinyl acetate resin, (b) 0.2–5.0 parts by weight of at least one thermal stabilizer selected from the group consisting of tin mercapto thermal stabilizers, tin maleate thermal stabilizers, and tin laurate thermal stabilizers, and (c) 0.2–5.0 parts by weight of at least one lubricant selected from the group consisting of metallic soap lubricants containing no cadmium or lead, polyethylene lubricants, and pentaerythritol lubricants to 100 parts by weight of a vinyl chloride resin.

The vinyl chloride resin according to the present invent ion is preferably at least one resin selected from the group consisting of vinyl chloride homopolymer resins, ethylene-vinyl chloride copolymer resins, and vinyl acetate-vinyl chloride copolymer resins, and the chlorinated vinyl chloride is prepared using a raw-material of vinyl chloride resin having a polymerization degree of 350–1100 so as to have a chlorine content of 60–70% by weight.

On the other hand, according to the production process of the present invention, a vinyl chloride fiber is prepared by melt spinning a vinyl chloride resin composition, which is obtained by formulating (a) 1–35 parts by weight of ethylene-vinyl acetate resin, (b) 0.2–5.0 parts by weight of thermal stabilizer, and (c) 0.2–5.0 parts by weight of lubricant to 100 parts of a vinyl chloride mixture consisting of 100–60% by weight of a vinyl chloride resin and 0–40% by weight of chlorinated vinyl chloride resin.

As the thermal stabilizer (b), there may be used at least one selected from the group consisting of tin thermal stabilizers, Ca—Zn thermal stabilizers, hydrotalcite thermal stabilizers, and zeolite thermal stabilizers, and as the lubricant (c), there may be used at least one selected from the group consisting of metallic soap lubricants containing no cadmium or lead, polyethylene lubricants, higher fatty acid lubricants, pentaerythritol lubricants, higher alcoholic lubricants, and montanonic acid wax lubricants.

Further, a vinyl chloride fiber may be prepared by melt spinning the vinyl chloride resin composition, which is obtained by formulating (a) 1–35 parts by weight of an ethylene-vinyl acetate resin, (b) 0.2–5.0 parts by weight of at least one thermal stabilizer selected from the group consisting of tin mercapto thermal stabilizers, tin maleate thermal stabilizers, and tin laurate thermal stabilizers, and (c) 0.2–5.0 parts by weight of at least one lubricant selected from the group consisting of metallic soap lubricants containing no cadmium or lead, polyethylene-lubricants, and pentaerythritol-lubricants to 100 parts by weight of a vinyl chloride resin mixture consisting of 90–75% by weight of a vinyl chloride resin and 10–25% by weight of a chlorinated vinyl chloride resin. Still further, a vinyl chloride fiber may be prepared by melt spinning the vinyl chloride resin composition, which is obtained by formulating (a) 1–35 parts by weight of an ethylene-vinyl acetate resin, (b) 0.2–5.0 parts by weight of at least one thermal stabilizer selected from the group consisting of tin mercapto thermal stabilizers, tin maleate thermal stabilizers, and tin laurate thermal stabilizers, and (c) 0.2–5.0 parts by weight of at least one lubricant selected from the group consisting of metallic soap lubricants containing no cadmium or lead, polyethylene lubricants, and pentaerythritol lubricants to 100 parts by weight of a vinyl chloride resin.

According to the production process of the present invention, the vinyl chloride resin composition of the present invention may be melt-spun by melt running-off the resin composition through nozzle orifices each having a sectional area of 0.5 $mm^2$ or less.

In addition, in the melt spinning described above, the vinyl chloride resin composition may be melted and run-off the resin composition through the nozzle orifices each having a sectional area of 0.5 $mm^2$ or less to prepare a 300-denier or less of undrawn filament, and then the undrawn filament is subjected to drawing process and heating process to a 100-denier or less of the fiber.

Still further, another process is available in which the vinyl chloride resin composition is melt-run off through the nozzle orifices at a nozzle pressure of 500 $kg/cm^2$ or less and at a resin temperature of 195° C., and the undrawn filament is simultaneously taken off at a spinning draft ratio of 25 or less.

Also, the process may use such the nozzle that has 50–300 orifices, the nozzle being used on the tip of a melt spinning die, and the orifices of the nozzles are arranged in the shape of circle, ellipse, rectangle, or square with a distance between adjacent nozzle orifices (a distance between each center of gravity of cross-sections in case that these two orifices have different shapes) is 0.8 mm or more.

Vinyl chloride resins used in the present invention include a conventionally known homopolymer resin that is a homopolymer of vinyl chlorides or a variety of previously known copolymer resins, however it is not intended to specifically limited thereto. As the copolymer resin, previously known copolymer resins can be employed, and those are typically exemplified copolymer resins between vinyl chloride and vinyl esters such as a vinyl chloride-vinyl acetate copolymer resin and a vinyl chloride-vinyl propionate copolymer resin, copolymer resins between vinyl chloride and acryl esters such as a vinyl chloride-butyl acrylate copolymer resin and a vinyl chloride-2-ethylhexyl acrylate copolymer resin, copolymer resins between vinyl chloride and olefins such as an ethylene-vinyl chloride copolymer resin and a vinyl chloride-propylene copolymer resin, and a vinyl chloride-acrylonitrile copolymer resin. A homopolymer of vinyl chloride, ethylene-vinyl chloride copolymer resin, vinyl acetate-vinyl chloride copolymer resin and the like are more preferably available. With regard to the copolymer resins, comonomers are not specifically restricted in their content, which contents can be determined in accordance with quality requirement such as molding property, filament property. It is particularly preferable that the content of comonomer is 2–30%.

The viscosity-average polymerization degree of vinyl chloride resin used in the present invention is preferably 450–1800. If the value is less than 450, fiber properties, specifically such characteristics as heat-shrinkage ratio, curl keeping property, and luster condition tend to lower, resulting in an undesired product. On the contrary, if the value is more than 1800, melting viscosity become higher, only resulting in higher nozzle pressure, it becomes to difficult to produce safely. In view of such balance between molding processability and fiber properties, viscosity-average polymerization degree is preferable in 650 to 1450 in a single use of vinyl chloride resin, whereas in use of copolymer resin, viscosity-average polymerization degree is particularly preferred to be 1000 to 1700 depending upon the comonomer contents.

Vinyl chloride resin of the present invention prepared by emulsion polymerization, block polymerization or suspension polymerization, or the like can be employed, while the vinyl chloride resin produced by suspension polymerization is preferred in view of the coloring of the fibers at an initial stage.

For the chlorinated vinyl chloride resin used in the present invention, preferably, there is used vinyl chloride resin as the raw-material, added by chlorine for reaction, then having raised a chlorine content thereof to 58–72 wt % (preferably 60–70 wt %), and for the main object thereof, it can be utilized in order to lower fiber heat-shrinkage ratio. Additionally, the chlorinated vinyl chloride resin has preferably the viscosity-average polymerization degree (as defined by that of vinyl chloride resin for raw material) of 300–1100. The viscosity-average polymerization degree of less than 300 would cause the fiber heat-shrinkage ratio to lower, resulting in the product afforded as a large shrinkage ratio. On the contrary, the viscosity-average polymerization degree of more than 1100 would result in a higher melting viscosity, which in turn would cause a higher nozzle pressure in melt spinning, thus making it difficult to operate safely as well as sometimes making it difficult to operate stably due to the remarkably more frequent filament-rupture (filament-breakage) at spinning stage. It is more preferred that the viscosity-average polymerization degree is 350–1100, particularly 500–900. Still further, with regard to the chlorine content, at less than 58 wt % its effect decreases in lowering the fiber heat-shrinkage ratio; whereas at more than 72 wt % , melting viscosity increases, causing an undesired result that safe operation sometimes become difficult.

Vinyl chloride resins, used as the raw material for the chlorinated vinyl chloride resins, are similar to the vinyl chloride resins mentioned above, and most preferable ones are such as products from the material of a homopolymer resin of vinyl chloride or an ethylene-vinyl chloride copolymer resin.

In the present invention, the ratio of vinyl chloride resin to chlorinated vinyl chloride resin is preferably (vinyl chloride/chlorinated vinyl chloride)=(100–60 wt %/0–40 wt %) as the corresponding vinyl chloride mixture. If the vinyl chloride is less than 60 wt % , chlorinated vinyl chloride resin become excessive. Consequently, melting viscosity becomes higher and nozzle pressure in melt spinning becomes higher, sometimes causing an undesired result that a safe operation becomes difficult. In addition, when a vinyl chloride ratio is excessive, there occurs a tendency to provide a fiber with a higher heat-shrinkage ratio. The ratio thereof may be utilized by adjusting as appropriate.

For the first object of the present invention to raise a fiber-flexibility and to allow a fiber to be soft, flexible, and dry-fingertouched, preferably 1–35 parts by weight of ethylene-vinyl acetate resin (abbreviated as EVA hereinafter) is added and blended to 100 parts by weight of vinyl-chloride mixture. Further, the resin has a secondary effect that the composition can be adjusted for its gelation and fusibility to give rise to a homogenous, appropriate molten condition, thereby allowing an appropriate nozzle pressure.

If the EVA resin is used below one part by weight, not only an improvement effect in fiber flexibility deteriorates, but gelation and fusibility may decrease in their adjustability to raise the nozzle pressure, as is often the case. On the contrary, if the EVA resin used is beyond 35 parts by weight, the resin composition decreases in its gelation and fusibility to become a heterogeneous gelation-molten condition, causing an undesired result that "stone"-like materials (unmolten particulates or particulates remaining undecomposed by shear stress) increase in the undrawn filament, causing an undesired result such that there occurs more frequently the filament-breakage either in melt spinning or in drawing and heat processing.

EVA resin, as used in the present invention, means the EVA resin comprising the conventionally known ethylene-vinyl acetate copolymer resin having 20–60 wt % of a vinyl acetate content and ethylene-vinyl acetate copolymer resin into which a polar carbonyl group is introduced, or an EVA-vinyl chloride graft copolymer resin which is afforded by graft-copolymerizing vinyl chloride with these EVA resins. An EVA-vinyl chloride graft copolymer resin can be readily provided by adding EVA resin into a polymerization system when suspension-polymerizing or emulsion-polymerizing vinyl chloride in aqueous medium. This resin is a mixture of EVA-vinyl chloride graft copolymer components which are afforded by chemical bonding of vinyl chloride with EVA resin-, polyvinyl chloride resin-, and EVA resin components in terms of extract fractionation with some solvent.

The vinyl acetate content of EVA resin used in the present invention is preferably in the range of 20–65 wt %. If vinyl acetate content is below 20 wt % or beyond 65 wt % , its compatibility decrease with the composition system to lower the gelation-fusibility adjustability of a component. Consequently, heterogeneous gelation-fusibility will cause to increase "stone"-like materials in undrawn filament, thereby bringing an undesired result such that filament-breakage often occurs in molten-spinning or drawing and heat processing. In addition, when vinyl acetate content is less than 20 wt % , the effect on improving the fiber flexibility becomes insufficient. On the contrary, if the vinyl acetate content is more than 65 wt % , EVA resin component, which remains to be homogeneously mixed in the composition, will be dissolved in molten-spinning, and melt down from a heating cylinder or the tip of nozzle, there arises a problem that it is difficult to obtain undrawn filament.

Further, melt index (MI: gr/10 min), as a measure of the molecular weight of the resin, is preferably about in the range of 1–260. If the melt index is less than one, EVA resin composition tends to increase in its melting viscosity and the nozzle pressure in molten-spinning tends to increase. On the contrary, if the melt index exceeds 260, the viscosity of the resin decrease, causing vinyl chloride mixture component to melt to less extent. As a result, a homogenous melting becomes poor so that the composition tends to remain as "stone" in undrawn filament, causing an undesired result such that the filament-breakage often occurs.

EVA-vinyl chloride graft copolymer resins that may be used in the present invention are preferably in the range of 3–45 wt % as EVA content thereof. If the content is below 3 wt % , the fiber flexibility may not fully improved. On the contrary, if the content exceeds 45 wt % , gelation-fusibility adjustment function deteriorates for the composition to cause heterogeneous the gelation-fusibility condition so that "stone"-like materials increase in undrawn filament, sometimes causing filament-breakage to occur in molten-spinning or drawing and heat processing.

Any of previously known thermal stabilizers may be used to practice, and particularly preferable is at least one thermal stabilizer selected from the group consisting of tin-, Ca—Zn-, hydrotalcite-, and zeolite-thermal stabilizers in the range of 0.2–0.5 parts by weight. The thermal stabilizers are used in order to improve a thermal decomposition in molding, long-run property, and a fiber color-tint. Most preferably used is at least one thermal stabilizer selected from the group consisting of tin mercapto-, tin maleate-, and tin laurate thermal stabilizers among tin-thermal stabilizers that yield a relatively small amount of scales around the nozzles (hereinafter, abbreviated as nozzle gum). There are exemplified as the thermal stabilizer, for example, tin mercapto-type such as tin mercapto dimethyl, tin mercapto dibythyl and tin mercapto dioctyl, tin maleate such as dimethyl tin maleate, dibuthyl tin maleate, dioctyl tin maleate, and dioctyl tin maleate polymer, and tin laurate such as dimethyl laurate, dibuthyl tin laurate, and dioctyl tin laurate.

In order to suppress the coloring at an initial stage and to increase the whiteness of natural compositions containing no pigment, it is especially preferred in which 0.1–1.4 parts by weight is used for the tin mercapto- thermal stabilizer to 100 parts by weight of a vinyl chloride mixture, so as to range from 0.2 to 5.0 parts by weight as the total parts thereof with other thermal stabilizer. The above-noted thermal stabilizers may be used by 0.2–5.0 parts by weight, in case of less than 0.2 part by weight, the effect sometimes deteriorates in preventing the thermal decomposition in molding. On the contrary, it exceeds 5.0 parts by weight, the nozzle gums are liable to occur in spinning to raise a fluctuation in run-off in spinning, such being undesired.

As the lubricants in the present invention may be used the previously known lubricants containing no cadmium or lead. More preferably, 0.2–5.0 parts by weight of one or two lubricants selected from the group of compositions consisting of metallic soap-, polyethylene-, higher fatty acid-, pentaerythritol-, higher alcoholic-, and montanonic acid wax lubricants are utilized to 100 parts of vinyl chloride mixture thereof. The lubricants are utilized for controlling the molten state of composition as well as the adhesive state between the composition and metallic surface, to remarkably affect on the surface state, touch feel, filament-breakage frequency, nozzle-gum occurring frequency, nozzle-pressure and the like.

In order to obtain a relatively dry feel, metallic soap lubricant is preferably used. In view of health, metallic soaps other than Cd and Pb are particularly preferred. For example, examples of metallic soaps include the stearate, laurate, palmitate and oleate such as Na, Mg, Al, Ca, and Ba. Additionally, in order to reduce the nozzle-gum generation frequency for suppressing the nozzle-pressure, preferably used are polyethylene lubricants such as those from the previously known. Especially preferable is a polyethylene resin which is non-oxidized or slightly polar and which has an average molecular weight of 1500–4000 as well as a density of 0.91–0.97. The polyethylene lubricant is especially preferred in the range of 0.2–1.3 parts by weight.

In the present invention, higher fatty acid-, pentaerythritol-, higher alcoholic-, montanonic acid wax lubricants are preferably used chiefly to control the melting state of compositions. As higher fatty acid lubricants, there are exemplified saturated fatty acids such as stearic acid, palmitic acid, myristic acid, lauric acid, capric acid, unsaturated fatty acid such as oleic acid or the mixtures thereof. Examples of pentaerythritol lubricants include monoester, diester, triester, tetraester, tetraester or the mixtures thereof prepared with pentaerythritol or dipentaerythritol and higher fatty acid. As higher alcoholic lubricants, there are exemplified stearyl alcohol, parmityl alcohol, mirystyl alcohol, lauryl alcohol, oleyl alcohol, and the like. Furthermore, as montanonic acid wax lubricants, there are exemplified montanonic acids and esters with higher alcohols such as stearyl alcohol, parmityl alcohol, mirystyl alcohol, lauryl alcohol, and oleyl alcohol.

The use range of the lubricants, especially preferably, is 0.5–3.0 parts by weight of metallic soaps containing no cadmium or lead, 0.2–1.8 parts by weight of polyethylene lubricants, or 0.2–1.0 part by weight of pentaerythritol to 100 parts by weight of vinyl chloride mixture.

As vinyl chloride composition in the present invention there may be used (a) those comprising 1–35 parts by weight of EVA resin, (b) 0.2–5.0 parts by weight of thermal stabilizer, and (c) 0.2–5.0 parts by weight of lubricant to 100 parts by weight of vinyl chloride mixture consisting of 100–60 wt % of vinyl chloride resin and 0–40 wt % of chlorinated vinyl chloride resin as well as those comprising (a) 1–35 parts by weight of EVA resin, (b) 0.2–5.0 parts by weight of one or more thermal stabilizers selected from the group consisting of tin mercapto-, tin maleate-, and tin laurate thermal stabilizers, and (c) 0.2–5.0 parts by weight of one or more lubricants selected from the group consisting of metallic soap lubricants containing no cadmium or lead, polyethylene- and pentaerythritol lubricants, to 100 parts by weight of vinyl chloride mixture consisting of 90–75 wt % of vinyl chloride resin and 10–25 wt % of chlorinated vinyl chloride resin.

The above-mentioned resin composition is preferable such that filament-breakage hardly occurs, the production thereof can stably made, and it is well balanced to the quality thereof.

In addition, vinyl chloride resin compositions comprising by formulating (a) 1–35 parts by weight of EWVA resin, (b) 0.2–5.0 parts by weight of one or more thermal stabilizers selected from the group consisting of tin mercapto-, tin maleate- and tin laurate thermal stabilizers, and (c) 0.2–5.0 parts by weight of one or more lubricants selected from the group consisting of metallic soap lubricants containing no cadmium or lead, polyethylene- and pentaerythritol lubricants to 100 parts by weight of vinyl chloride resin.

The above-described composition tends to raise heat-shrinkage ratio of resin. However, in lieu of the stable production therefrom as an advantage, it is preferably used if the larger fiber shrinkability is required.

In the present invention, the known formulation ingredients used for vinyl chloride compositions may be used, according to an individual purpose, such as processing aid, strengthen filler, UV absorber, antioxidant, plasticizer, antistatic agent, fire retardancy and pigment. Additionally, occasion demands, special formulation ingredients may be appropriately used such as foaming agent. crosslinker, tackifier, hydrophilic-nature producer, conductive reinforcer and perfume.

The above processing aids include, for example, acrylate processing-aids containing mainly methyl methacrylate or polyester processing aids containing mainly thermoplastic polymers. As the use amount of the processing aids, 0.2–12 parts by weight is preferred to 100 parts by weight of vinyl chloride mixture. Additionally, such processing aids may be either used individually or as a mixture of two or more components. As the filler used in the present invention, thhere are exemplified $CaCO_3$, $MgCO_3$, $MgO_2$, $Al_2O_3$, $Mg(OH)_2$, $Al(OH)_3$, talc, mica and clay. As the use amount of the filler, 0.2–5.0 parts by weight thereof is preferred to 100 parts by weight of a vinyl chloride mixture. Further, such fillers may be used individually or as a mixture of two or more components.

As the plasticizers used in the present invention include phthalate plasticizers such as dibutyl phtalate, di-2-ethylhexyl phthalate, di-isononyl phthalate, trimellitate plasticizers such as octyl trimellitate, pyromellitate plsticizers such as octyl pyromellitate, polyester- and epoxy-plasticizers and the like. As the use amount of the plasticizers is preferred 0.2–5.0 parts by weight to 100 parts by weight of a vinyl chloride mixture and such plasticizers may be used individually or as a mixture of two or more components.

The vinyl chloride resin composition used in the present invention may be used as powder compounds prepared by blending using the previously known mixtures such as Henschel mixture, Super mixture, or ribbon blender, or as pellet compounds prepared by melt-blending thereof. The powder compound can be prepared under the conventional normal conditions previously known, being as either hot or cold blending. Most preferably, in order to reduce the volatile portions in a composition, hot blending is conducted at a temperature of from 105 to 155° C. as a cutting temperature upon blending. The pellet compound can be prepared in the same manner as in the conventional vinyl chloride pellet compounds. For example, pellet compounds may be prepared by means of uniaxial extruder, different-directional biaxial extruder, conical biaxial extruder, unidirectional biaxial extruder, Ko-kneader, planetary gear extruder, kneaders such as roll kneader. Regarding the conditions when the pellet compounds are prepared, there is no restriction, but the resin temperature is preferably set to be 185° C. or less. Additionally, in order to remove foreign matters such as metal swarfs that may be contaminated from some cleaning tools, the following measures are desirably available and hot cut measure is especially preferred because of a small amount of "cut powder" contamination: (a) a stainless mesh with small perture or the like is placed within a kneader; (b) some measure that enables removing "cut powder" that may be contaminated at cold process; and a hot cut is carried out.

When a vinyl chloride resin composition is made into undrawn filament, the conventionally known extruders can be used. For example, uniaxial-, different-directional biaxial-extruders, conical biaxial extruder, and the like may be used, and especially preferred is a uniaxial extruder with a bore of about 35–85 mm in diameter or a conical extruder with a bore of about 35–50 mm in diameter. If the bore is too large in diameter, the extrusion volume is also large. As a result, the nozzle pressure or the exit velocity of undrawn filament will be excessive, sometimes causing taking-up to be difficult, such being undesired.

In the present invention, a nozzle having a cross sectional area of 0.5 $mm^2$ or less is preferably secured to the tip of a die so as to conduct melt spinning. If a nozzle having a cross sectional area of 0.5 $mm^2$ or more is used, the undrawn filament increases in fineness, whereas drawing ratio is need to be increased upon drawing process so as to provide a fiber having a small fineness. For that reason, the small-fineness filament (drawn filament) after being subjected to an drawing process has luster, thereby being difficult to keep the half to seven-tenth of a full luster, sometimes allowing such fiber to become rough-feel and glaring or a smooth-feel like plastic, such being undesired.

The arrangement or position alignment of nozzle orifices in the nozzle has much relationship with a readiness in taking-up. The especially preferred arrangement is one to five rows. An increase in the number of rows often allows the flow or run-off velocity of the melt product in the die to differentiate more or to distribute wider, sometimes causing a "filament slacks" of an undrawn fiber to occur more, such being undesired. Additionally, array-configuration thereof is preferably circle, ellipse or polygon having at least four arcs. Such polygon of triangle would allows the flow or run-off velocity of the melt product in the die to differentiate more or to distribute wider, sometimes causing a "filament slack" of an undrawn fiber to occur more, such being undesired. Further, the number of nozzle orifices in a nozzle is preferably 50 to 300. If such number is small, productivity lowers, whereas if too large, trouble incidence such as filament-breakage becomes greater, such being undesired.

In the present invention, the distance between the centers of two adjacent nozzles (in case that such cross-section shapes are different from each other, the distance between the centers of gravity thereof) is arrayed so as to have 0.8 mm or more. If the distance is less than 0.8 mm, the contact frequency among undrawn filaments in melt spinning increases to cause filament-breakage to occur more often, such being undesired. Further, an excessiveness in the distance would allow the nozzle itself to enlarge, leading to an undesired result that the nozzle becomes heavier and that the number of orifices arrayed in the nozzle decreases to deteriorate process productivity. The preferred range thereof is 0.8 to 3.8 mm.

According to the present invention, the fineness of an undrawn fiber is preferably to remain 300 denier or less. If the fineness of the undrawn fiber exceeds 300 denier, drawing ratio is necessary to be increased in drawing process so as to produce a fiber with a smaller fineness. As a result, the fiber with a small fineness subjected to the drawing processing (drawn filament) has luster so that it become difficult to keep the luster as being half to seven-tenth of a full luster. There is also a tendency it has the smooth feel like plastic. In addition, preferably, spinning is carried out at nozzle pressure of 500 $kg/cm^2$ or less. If the nozzle pressure exceeds 500 $kg/cm^2$, an excessive load is applied to a thrust of the extruder, more frequent trouble occurs than usual, such being undesired. When the nozzle pressure is controlled by regulating the extruding amount therefrom, that is, changing screw r.p.m. or feeding amount, these affect the product quality to a small degree, such being desirable. However, since productivity decreases as an extruding amount decreases, a pressure range of 480–300 $kg/cm^2$ is preferred in view of their balance. In order to reduce the nozzle pressure, such a lubricant having a large slip factor against metallic surface, or a large amount of an agent for lowering melting viscosity such as plasticizer or polymer plasticizer may be used. However, if the nozzle pressure is set to 200 $kg/cm^2$ or less by means of the above, the gel and melt state of a composition becomes extremely heterogeneous to thereby cause filament-breakage more often. As a result, not only it becomes difficult to produce but a fiber is sometimes poor in its quality such as luster condition and feel. Accordingly, the pressure control by the regulation of extrusion amount described above is preferable.

A strand after being melted and run-off from the nozzle orifices is subjected to drawing into an undrawn filament with a 300 denier or less in a melt spinning process, the drawing ratio at that time is especially preferred to be 25 or less. If the drawing ratio exceeds 25, the surface of the fiber has been excessively drawn at the stage of the undrawn filament. As a result, there is a tendency that a fiber with a small fineness has luster after drawing process, so that it is difficult to keep half to seven-tenth of the full luster. Also, it is likely to have a smooth feel like plastics. Additionally, the resin is preferably spun at a temperature of 195° C. or less. If the spinning is carried out at a temperature exceeding 195° C., a fiber undergoes a remarkable coloring to often become a strongly yellow fiber, such being undesired. Therefore, particularly preferable is the cylinder temperature of about 150–185° C. and the die temperature of about 160–190° C.

As described above, i n the present invention, it is especially preferred that the nozzle having its sectional area of 0.5 $mm^2$ or less is used upon melt spinning, to obtain an undrawn filament having a 300 denier or less. In particular, the most advantageous process for effecting the present invention is as follows. That is, the nozzle pressure is set to 500 $kg/cm^2$ or less, the number of nozzle orifices is set to 50 to 300, the nozzle array-configuration is a circle, ellipse or polygon having four arcs or more, and the number of nozzle alignment is one to five.

A small-fineness fiber having a 100 denier or less (drawn filament) may be obtained by subjecting to drawing and heat processing the undrawn filament produced by the melt spinning according to the known process. The particularly preferred ranges are 25 to 100 deniers for use in the human hair decoration and 10 to 65 deniers for use in the doll-hair accessory.

Regarding the requirement for drawing process, drawing ratio is particularly preferable about 200 to 450% under an atmosphere of drawing process temperatures of from 70 to 150° C. If the temperature for drawing process is less than 70° C., not only the fiber strength becomes low, but filament-breakage readily occurs. On the contrary, if it exceeds 150° C., a fiber feel undesirably becomes a smooth feel like plastic. Additionally, if an drawing ratio is less than 200%, the fiber performs an insufficient strength, and if it exceeds 450%, filament-breakage readily occurs upon drawing process, both of the above being undesired.

Furthermore, the fiber that has been subjected to an drawing process is subjected to a heating process to conduct a relaxation process for the drawn fiber over relaxation ratio of 2–75%, thereby being capable of lowering a heat shrinkage ratio. Further, such the relaxation process is preferred in order to allow the product fiber to have a feel like human hair as well as half to seven-tenth of the full luster by adjusting an irregularity of the surface of the fiber. If the above relaxation process is conducted out of the range, the resulting quality tends to deteriorate as the artificial hair or the doll-hair fibers, such being undesired. The heat processing may be carried out individually or in association with the drawing process. As the processing condition, it is especially preferred to be carried out at an atmospheric temperatures of from 80 to 150° C. In addition, according to the present invention, the conventionally known technologies relating to melt spinning, for example, such as technologies relating to various sectional shapes of nozzles, technologies relating to heating cylinders, technologies relating to drawing processes, and technologies relating to heating processes may be employed optionally in combination therewith.

DETAILED DESCRIPTION OF THE PREFERRED EMBODIMENTS

Detailed descriptions will be made of the preferred embodiments with reference to examples, but it is to be noted that the present invention is not limited to the specific examples.

In the following description, the contents in the tables and others are abbreviated as follows:

vinyl chloride resin="PVC"; chlorinated vinyl chloride resin="CPVC"; vinyl acetate="VAc"; viscosity-average polymerization degree="M"; melt index="MI".

Additionally, in the tables 2, 4–6, 8–9, the values of formulation ingredient in the composition represent parts by weight based on 100 parts by weight of the total of PVC and CPVC.

Experiments 1–5 (PVC/CPVC Formulation Ratio)

100 parts by weight of vinyl chloride mixture was measured 4 kg, and then each formulation ingredient shown in Table 2 was measured into a 20-litter Henschel mixer, and stirred and mixed while agitating until the contents temperature reached 115° C. Thereafter, cooling water is caused to circulate within a jacket of Henschel mixer, while continuing stirring and mixing until the contents temperature is cooled to reach 75° C. to obtain a vinyl chloride powder compound. The powder compound was subjected to melt spinning-, drawing-, heat-processing experiments under the conditions shown in Table 1 (Spinning Condition 1).

TABLE 1

| | Spinning Condition 1 |
|---|---|
| Extruder | 40 m/mϕ Uniaxial Extruder, L/D = 24 |
| Screw | Full Flighted Type, Compression Ratio = 2.5 |
| Nozzle | Orifice Cross-Section = 0.063 $mm^2$<br>Orifice Number = 120, Circular Array |
| Cylinder Temperature | C1 = 155° C., C2 = 160° C.<br>C3 = 165° C., C4 = 170° C. |
| Adapter Temperature | AD = 175° C. |
| Turn-head Temperature | TH = 180° C. |
| Nozzle Temperature | NH = 180° C. |
| Spinning Heat Cylinder Temperature | HT = 320° C.: Atmospheric Temperature |
| Drawing Process | Atmospheric Temperature: 110° C. |
| Relaxation Process | Atmospheric Temperature: 110° C. |

As to melt spinning experiments, after reaching stationary state, the relationship between screw r.p.m. and extruding amount were measured and the screw r.p.m. is determined so that the extruding amount becomes 7.0 kg/hr. Nozzle pressures and resin temperatures were measured, respectively, using a die-pressure gage and a resin thermometer disposed at the nozzle portion.

A strand that has melted and run-off from the nozzle was vertically introduced into a spinning heat cylinder, where the strand was heated to melt instantaneously and the resulting undrawn filament was taken off using take-off unit placed 3 m right below the nozzle at a constant speed. At the same time, take-off speed was regulated so that the undrawn filament had 165–185 deniers. At the stage for producing an undrawn filament, the filament-breakage incidence was visually observed and evaluated as follows.

Filament-Breakage Incidence at Melt Spinning Stage

◎: no filament-breakage occurred

○: not more than 3 times occurred per hour

Δ: 4–15 times occurred per hour

Additionally, the coloring degree of the undrawn filament was evaluated using visual observation as follows.

Coloring of Undrawn Filaments

◎: milk white and no yellowish

○: milk white and little yellowish

Δ: markedly strong yellowish

The undrawn filament was introduced into an drawing-heating process unit to conduct drawing process, and then thermal relaxation process was conducted to produce the drawn filament. At this stage, thermal relaxation was conducted while the value was fixed to 25%, and the drawing process was conducted while slightly adjusting an drawing ratio so that the final drawn filament had 65–68 deniers. The filament-breakage incidence at the drawing-heating process was visually observed and evaluated as follows.

Filament-Breakage Incidence at Drawing-Heating Process

◎: no filament-breakage occurred

○: not more than 3 times occurred per hour

Δ: 4 to 15 times occurred per hour.

Additionally, the surface luster and gloss were visually observed and evaluated as follows.

Luster Condition of Drawn Filament

◎ (semi-gloss): smooth surface and faint dull

○ (seven-tenth of the full luster): smooth surface and dull

● (fully matte state): rough-felt surface and no gloss

Δ (eight-tenth of the full luster): rough-felt surface, local luster and brilliance X (gloss-positive state): smooth surface, entire gloss and brightness Additionally, the drawn filament was touched by hand and the hand feel was evaluated as follows.

Feel of Drawn Filament

◎: smooth surface and dry feel

○: smooth surface, slightly wet feel, and dry feel

Δ (rough feel): rough surface and rough feel

● (plastic feel): smooth surface, plastic feel, and slippery feel

Further, while the drawn filament was wound around a finger a few times, repulsive force, feel and softness thereof were evaluated as follows.

Flexibility of Drawn Filament

◎: soft to finger, and can be flexibly wound around

○: faint repulsion feel, but can be flexibly wound around

Δ: totally hard feel, and strong repulsion feel

The drawn filament was subjected to drawing test and filament-shrinkability test, and the strength and the heat-shrinkage ratio thereof were determined. Additionally, heat-shrinkage ratio was measured by subjecting the test fiber to heat shrinkage at atmospheric temperatures of 100° C. for 25 minutes, and evaluated according to the following equation:

(length of the drawn filament before heat processing—length of the drawn filament after heat processing)/(length of drawn filament before heat processing) X100=heat-shrinkage ratio (wt %)

The evaluation results obtained are shown in Table 2.

TABLE 2

Effects of PVC/CPV Formulation Ratio

| Experiment Number: Examples or Comparative Example | | | No. 1 Example | No. 2 Example | No. 3 Example | No. 4 Example | No. 5 Comparative Example |
|---|---|---|---|---|---|---|---|
| PVC (*1) | | | 100 | 90 | 75 | 60 | 50 |
| CPVC (*2) | | | 0 | 10 | 25 | 40 | 80 |
| EVA Resin (*3) | | | 3 | 3 | 3 | 3 | 3 |
| Processing Aid (*4) | | | 1.3 | 1.3 | 1.3 | 1.3 | 1.3 |
| Tin Thermal Stabilizer (*5) | | | 0.5 | 0.5 | 0.5 | 0.5 | 0.5 |
| Tin Thermal Stabilizer (*6) | | | 0.5 | 0.5 | 0.5 | 0.5 | 0.5 |
| Calcium stearate | | | 0.6 | 0.3 | 0.6 | 0.6 | 0.6 |
| Polyethylene Wax | | | 0.5 | 0.5 | 0.5 | 0.5 | 0.5 |
| Stearic acid/Lauryl Alcohol | | | 0.5/0.8 | 0.5/0.8 | 0.5/0.8 | 0.5/0.8 | 0.5/0.8 |
| at Melt | Nozzle Pressure(Kg/cm$^2$) | | 439 | 448 | 464 | 492 | 557 |
| spinning: | Resin Temperature (° C.) | | 187 | 188 | 188 | 188 | 189 |
| | Filament-Breakage Incidence | | ◎ | ◎ | ○ | ○ | Δ |
| | Undrawn filament | Extruding amount (Kg/Hrs) | 7.0 | 7.0 | 7.0 | 7.0 | 7.0 |
| | Length = Exit | Fineness d (denier) | 167 | 179 | 168 | 174 | 181 |
| | | Coloring | ◎ | ◎ | ◎ | ○ | Δ |
| Filament-breakage Incidence in Drawing-Heating Processing | | | ◎ | ◎ | ◎ | ○ | Δ |
| Drawn | Fineness (denier) | | 66 | 67 | 65 | 66 | 68 |
| filament | Luster (Surface Gloss) | | ○ | ◎ | ◎ | ◎ | • |
| | Feel (hand feel) | | ○ | ○ | ◎ | ◎ | Δ |
| | Flexibility (Finger-wound Method) | | ○ | ○ | ○ | ○ | Δ |
| | Strength (g/d) | | 1.57 | 1.55 | 1.63 | 1.62 | 1.33 |
| | Heat-Shrinkage Ratio (%, at 100° C.) | | 8.8 | 5.3 | 2.4 | 2.6 | 2.7 |

(*1): PVC[S1001] (M = 1000), a product of Kaneka Corporation (*2): CPVC (Chlorine content = 64 wt %, M ≒ 800), a product of Kaneka Corporation (*3): EVA Resin (VAc Content = 25 wt %, MI = 3)

(*4): Acrylate Processing Aid (Kaneace PA20), a product of Kaneka Corporation (*5): Mercapto Octyl Tin Thermal Stabilizer, a product of Sankyo Yuki Gosei, Co.

(*6): Butyl Tin Maleate Thermal Stabilizer, a product of Sankyo Yuki Gosei, Co.

As is shown by comparison among Experiments 1–5, when the formulation ratio of chlorinated vinyl chloride resin is above 40 wt %, a nozzle pressure becomes 500 kg/cm$^2$ or more, that is, more than the designed pressure of the extruder, causing a safe operation to become difficult. In addition, if the screw r.p.m. is decreased, the extruding amount decreases, resulting in a tendency to decrease productivity. Further, if the formulation ratio of the chlorinated vinyl chloride resin exceeds 40 wt % , there still more frequently occurs the filament-breakage in melt spinning as well as a tendency to allow undrawn filament to become yellowish a little. Still further, the gloss of the drawn filament excessively disappears and the feel becomes rough, thus resulting in a less flexibility of the fiber. These experiments demonstrates that the vinyl chloride resin is particularly preferred to be formulated with the chlorinated vinyl chloride resin in a ratio of (100–60): (0–40) in wt % (percent by weight).

Experiments 6–11 (Effects of Addition of EVA Resin)

As in the experiment 1–5, 100 parts by weight of vinyl chloride mixture was measured 4 kg, and then an addition amount of EVA resin was changed. Each formulation ingredient shown in Table 4 was measured, and thrown into a 20-litter Henschel mixer, followed by stirring and mixing until the contents temperature reached 135° C. Thereafter, cooling water is caused to circulate within a jacket of Henschel mixer, while continuing stirring and mixing until the contents temperature is cooled to reach 70° C. to obtain a vinyl chloride powder compound. The powder compound was subjected to melt spinning, drawing and heat processing under the conditions shown in Table 3 (Spinning Condition 2) for spinning-, drawing- and thermal relaxation processing.

TABLE 3

| | Spinning Conditions 2 |
|---|---|
| Extruder | 40 mm Conical Biaxial Extruder |
| Screw | Deep needing Type |
| Nozzle | Orifice Sectional Area = 0.085 mm$^2$<br>Orifice Number = 120, Circular Array |
| Cylinder Temperature | C1 = 160° C., C2 = 160° C.<br>C3 = 160° C., C4 = 165° C. |
| Adapter Temperature | AD = 165° C., |
| Turn-head Temperature | TH = 170° C., |
| Nozzle Temperature | NH = 170° C., |
| Spinning Heat cylinder Temperature | HT = 290° C.: Atmospheric Temperature |
| Drawing Process | Atmospheric Temperature: 115° C. |
| Thermal Relaxation Process | Atmospheric Temperature: 115° C. |

As to the melt spinning experiments, the relationships of the extruding amount with the feeding amount and the screw r.p.m. were evaluated after stationary state was established, and determined the feeding amount and the screw r.p.m. were determined so that an extruding amount becomes 7.0 kg/Hr. Nozzle pressures and resin temperatures were measured, respectively, using a die-pressure gage and a resin thermometer disposed at the nozzle portion. A strand that has melted and run-off from the nozzle was vertically introduced into a spinning heat cylinder, where the strand was heated to melt instantaneously and the resulting undrawn filament was taken off using take-off unit placed 3 m right below the nozzle at a constant speed. At the same time, take-off speed was regulated so that the undrawn filament had 154–176 deniers. As to other spinning conditions were similar to those with Experiments 1–5, and evaluation procedures were the same as those with Experiments 1–5. The results obtained are shown in Table 4.

TABLE 4

Effects of EVA Resin

| Experiment Number: Examples or Comparative Examples | | | No. 6 Comparative Example | No. 7 Example | No. 8 Example | No. 9 Example | No. 10 Example | No. 11 Comparative Example |
|---|---|---|---|---|---|---|---|---|
| PVC (*1) | | | 85 | 85 | 85 | 85 | 85 | 85 |
| CPVC (*2) | | | 15 | 15 | 15 | 15 | 15 | 15 |
| EVA Resin (*3) | | | 0.5 | 1 | 3 | 15 | 30 | 38 |
| Processing Aid (*4) | | | 1.3 | 1.3 | 1.3 | 1.3 | 1.3 | 1.3 |
| Tin Thermal Stabilizer (*5) | | | 0.5 | 0.5 | 0.5 | 0.5 | 0.5 | 0.5 |
| Tin Thermal Stabilizer (*6) | | | 0.5 | 0.5 | 0.5 | 0.5 | 0.5 | 0.5 |
| Calcium stearate/ Barium stearate | | | 0.6/0.4 | 0.6/0.4 | 0.6/0.4 | 0.6/0.4 | 0.6/0.4 | 50.6/0.4 |
| Polyethylene Wax | | | 0.5 | 0.5 | 0.5 | 0.5 | 0.5 | 0.5 |
| Dipentaerythritol tetrastearate | | | 0.4 | 0.4 | 0.4 | 0.4 | 0.4 | 0.4 |
| Calcium Carbonate | | | 2.0 | 2.0 | 2.0 | 2.0 | 2.0 | 2.0 |
| at Melt spinning | Nozzle Pressure (Kg/cm$^2$) | | 444 | 437 | 434 | 436 | 430 | 527 |
| | Resin Temperature (° C.) | | 187 | 187 | 187 | 187 | 187 | 186 |
| | Filament-Breakage Incidence | | ◎ | ◎ | ◎ | ◎ | ○ | Δ |
| | Undrawn filament | Extruding amount (Kg/Hrs) | 7.0 | 7.0 | 7.0 | 7.0 | 7.0 | 7.0 |
| | | Fineness d (Denier) | 177 | 170 | 167 | 169 | 166 | 154 |
| | | Coloring | ◎ | ◎ | ◎ | ◎ | ◎ | ◎ |
| Filament-breakage Incidence in Drawing-Heat Processing | | | ◎ | ◎ | ◎ | ◎ | ○ | Δ |

TABLE 4-continued

| Experiment Number: Examples or Comparative Examples | | Effects of EVA Resin | | | | | |
|---|---|---|---|---|---|---|---|
| | | No. 6 Comparative Example | No. 7 Example | No. 8 Example | No. 9 Example | No. 10 Example | No. 11 Comparative Example |
| Drawn filament | Fineness (Denier) | 68 | 67 | 65 | 66 | 66 | 65 |
| | Luster(Surface Gloss) | ○ | ◎ | ◎ | ◎ | ◎ | • |
| | Feel (Hand Feel) | Δ | ○ | ◎ | ◎ | ◎ | Δ |
| | Flexibility (Finger-wound method) | Δ | ○ | ◎ | ◎ | ○ | Δ |
| | Strength (g/d) | 1.52 | 1.54 | 1.59 | 1.63 | 1.62 | 1.31 |
| | Heat-Shrinkage Ratio(%, at 100° C.) | 3.8 | 3.0 | 2.2 | 2.1 | 2.8 | 2.7 |

(*1): PVC[S1001] (M = 1000), a product of Kaneka Corporation
(*2): CPVC (Chlorine content = 64 wt %, M ≒ 800), a product of Kaneka Corporation
(*3): EVA Resin (VAc Content = 25 wt %, MI = 5)
(*4): Acrylate Processing Aid (Kaneace PA20), a product of Kaneka Corporation
(*5): Mercapto Octyl Tin thermal Stabilizer, a product of Sankyo Yuki Gosei Co.
(*6): Butyl Tin Maleate Thermal Stabilizer, a product of Sankyo Yuki Gosei Co.

As is shown by comparison among Experiments 6–11, when an addition amount of EVA resin is less than one part by weight, the flexibility of an drawn filament becomes poor, thus resulting in a rough-feel fiber. Also, there is a tendency that a heat-shrinkage ratio becomes a litter higher. Additionally, when the EVA resin addition amount exceeds 35 parts by weight, a composition ununiformity occurs (that is, the CPVC component was melted heterogeneously), thus resulting in a frequent filament-breakage in melt spinning or drawing processing. Further, a nozzle pressure tends to increase, and the fiber becomes rough. These experiments demonstrates that the EVA resin is preferred to be added within a range of 1–35 parts by weight to 100 parts by weight of chlorinated vinyl chloride resin.

Experiments 12–16 (Effects of Addition and Combination use of Thermal Stabilizer)

As in the experiment 1–5, 100 parts by weight of vinyl chloride mixture was measured 4 kg, and then an addition amount and the kinds of thermal stabilizers were changed. Each formulation ingredient shown in Table 5 was measured, and thrown into a 20-litter Henschel mixer, followed by stirring and mixing until the contents temperature reached 135° C. Thereafter, cooling water is caused to circulate within a jacket of Henschel mixer, while continuing stirring and mixing until the contents temperature is cooled to reach 70° C. to obtain a vinyl chloride powder compound. Incidentally, the EVA resins were prepared by graft-copolymerizing vinyl chloride with 25 wt % of vinyl acetate and vinyl chloride with melt index of 5 and adjusting an EVA content to 40 wt % for use. The powder compound obtained was subjected to melt spinning-, drawing-, and heat processing experiments under the conditions similar to those described in the experiments 6–11 as the spinning, drawing, and relaxation conditions. Further, according to the test procedures and evaluation process shown in Experiments 6–11, undrawn filaments and drawn filaments were evaluated in the similar manner. The evaluation results are shown in Table 5.

TABLE 5

| Experiment Number: Examples or Comparative Examples | Effects of Addition and Combination Use of Thermal Stabilizer | | | | |
|---|---|---|---|---|---|
| | NO. 12 Comparative Example | NO. 13 Example | NO. 14 Example | NO. 15 Example | NO. 16 Comparative Example |
| PVC (*1) | 85 | 85 | 85 | 85 | 85 |
| CPVC (*2) | 15 | 15 | 15 | 15 | 15 |
| EVA Resin (*3) | 20 | 20 | 20 | 20 | 20 |
| Processing Aid (*4) | 1.5 | 1.5 | 1.5 | 1.5 | 1.5 |
| Tin Thermal Stabilizer (*5) | 5.5 | 0.5 | 0.5 | 0.5 | 0.5 |
| Ca–Zn composite thermal Stabilizer | — | 1.5 | — | — | — |
| Hydrotalcite | — | — | 2.5 | — | — |
| Zeolite | — | — | — | 3.5 | 5.0 |
| Calcium Stearate/Magnesium Stearate | 0.6/1.4 | 0.6/1.4 | 0.6/1.4 | 0.6/1.4 | 0.6/1.4 |
| Dipentaerythritol tetrastearate | 0.4 | 0.4 | 0.4 | 0.4 | 0.4 |

TABLE 5-continued

| Effects of Addition and Combination Use of Thermal Stabilizer | | | | | | |
|---|---|---|---|---|---|---|
| Experiment Number: Examples or Comparative Examples | | NO. 12 Comparative Example | NO. 13 Example | NO. 14 Example | NO. 15 Example | NO. 16 Comparative Example |
| Clay | | 2.0 | 2.0 | 2.0 | 2.0 | 2.0 |
| at Melt spinning: | Nozzle Pressure ($Kg/cm^2$) | 543 | 441 | 466 | 479 | 495 |
| | Resin Temperature(° C.) | 190 | 187 | 187 | 187 | 186 |
| | Filament-Breakage Incidence | Δ | ◎ | ◎ | ○ | Δ |
| | Undrawn filament Extruding amount (Kg/Hrs) | 6.8 | 6.8 | 6.8 | 6.8 | 6.8 |
| | Fineness d (denier) | 172 | 169 | 171 | 169 | 169 |
| | Coloring | ◎ | ◎ | ◎ | ◎ | ◎ |
| Filament-breakage Incidence in Drawing-Heat Processing | | Δ | ◎ | ◎ | ○ | Δ |
| Drawn filament | Fineness (denier) | 66 | 67 | 65 | 66 | 64 |
| | Luster (Surface Gloss) | ◎ | ◎ | ◎ | ◎ | ◎ |
| | Feel (Hand Feel) | Δ | ◎ | ○ | ○ | Δ |
| | Flexibility (Finger-wound method) | ◎ | ◎ | ○ | ○ | Δ |
| | Strength (g/d) | 1.60 | 1.59 | 1.55 | 1.52 | 1.16 |
| | Heat-Shrinkage Ratio (%, at 100° C.) | 12.5 | 3.2 | 3.7 | 4.7 | 5.7 |

(*1): PVC[S1001] (M = 1000), a product of Kaneka Corporation (*2): CPVC (Chlorine content = 64 wt %, M ≒ 800), a product of Kaneka Corporation (*3): EVA Resin (EVA-vinyl chloride graft copolymer)

(*4): Acrylate Processing Aid (Kaneace PA20), a product of Kaneka Corporation (*5): Butyl Tin Maleate Thermal Stabilizer, a product of Sankyo Yuki Gosei Co.

As is shown by comparison among Experiments 12–16, when an addition amount of thermal stabilizer is proper, coloring for an undrawn filament at an initial stage is high. However, when butyl tin maleate is used excessively, the heat-shrinkage ratio becomes extremely larger, thus resulting in an insufficient quality of fiber. Also, an inorganic-powder thermal stabilizer, for example, such as zeolite, is used excessively, not only a rough-feel fiber yields, but filament-breakage occurs remarkably more frequently, thus the strength of the fiber deteriorated. These experiments demonstrate that the addition amount of the thermal stabilizer is preferred to be in a range of 0.2–5.0 parts by weight to 100 parts by weight of the vinyl chloride resin.

Experiments 17–21 (Effects of Nozzle Sectional Area)

As in the experiment 1–5, 100 parts by weight of vinyl chloride mixture was measured 4 kg. Each formulation ingredient shown in Table 6 was measured, and thrown into a 20-litter Henschel mixer, followed by stirring and mixing until the contents temperature reached 125° C. Thereafter, cooling water is caused to circulate within a jacket of Henschel mixer, while continuing stirring and mixing until the contents temperature is cooled to reach 75° C. to obtain a vinyl chloride powder compound. Incidentally, the EVA resins were prepared by graft-copolymerizing vinyl chloride with 65 wt % of vinyl acetate and vinyl chloride with melt index of 15 and adjusting an EVA content to 25 wt % for use. The powder compound obtained was subjected to melt spinning-, drawing-, and heat processing experiments under the conditions similar to those described in the experiments 1–5 as the spinning, drawing, and relaxation conditions. Further, according to the test procedures and evaluation process shown in Experiments 6–11, undrawn filaments and drawn filaments were evaluated in the similar manner. The evaluation results are shown in Table 5. At this stage, the spinning experiment was carried out while the sectional area of the nozzle and the number of the orifice were changed to those shown in Table 6. Further, the extruding amount was set to be 7.8 kg/Hr, and the take-off velocity and drawing ratio were adjusted. Further, according to the test procedures and evaluation process shown in the experiments 1–5, undrawn filaments and drawn filaments were evaluated in the similar manner. The evaluation results are shown in Table 6.

TABLE 6

Effects of Nozzle Sectional Area

| Experiment Number: Examples or Comparative Example | | | NO. 17 Example | NO. 18 Example | NO. 19 Example | NO. 20 Example | NO. 21 Comparative Example |
|---|---|---|---|---|---|---|---|
| PVC (*1) | | | 85 | 85 | 85 | 85 | 85 |
| CPVC (*2) | | | 15 | 15 | 15 | 15 | 15 |
| EVA Resin (*3) | | | 18 | 18 | 18 | 18 | 18 |
| Processing Aid (*4) | | | 1.5 | 1.5 | 1.5 | 1.5 | 1.5 |
| Colorhermal Stabilizer (*5) | | | 0.5 | 0.5 | 0.5 | 0.5 | 0.5 |
| Colorhermal Stabilizer (*6) | | | 0.4 | 0.4 | 0.4 | 0.4 | 0.4 |
| Calcium Stearate/Magnesium Stearate | | | 0.6/1.4 | 0.6/1.4 | 0.6/1.4 | 0.6/1.4 | 0.6/1.4 |
| Dipentaerythritol tetrastearate | | | 0.4 | 0.4 | 0.4 | 0.4 | 0.4 |
| Polyethylene Wax | | | 0.5 | 0.5 | 0.5 | 0.5 | 0.5 |
| Calcium Carbonate | | | 2.0 | 2.0 | 2.0 | 2.0 | 2.0 |
| Sectional area ($mm^2$) of a Nozzle orifice/Number of nozzle orifices | | | 0.05/140 | 0.08/120 | 0.15/130 | 0.48/130 | 0.55/130 |
| at Melt spinning: | Nozzle Pressure ($Kg/cm^2$) | | 487 | 445 | 403 | 386 | 358 |
| | Resin Temperature (° C.) | | 186 | 187 | 186 | 186 | 186 |
| | Filament-Breakage Incidence | | ◎ | ◎ | ◎ | ◎ | ◎ |
| | Undrawn filament | Extruding amount (Kg/Hrs) | 7.80 | 7.80 | 7.80 | 7.80 | 7.80 |
| | | Fineness d (Denier) | 168 | 167 | 169 | 166 | 168 |
| | | Coloring | ◎ | ◎ | ◎ | ◎ | ◎ |
| Filament-breakage Incidence in Drawing-Heat Processing | | | ◎ | ◎ | ◎ | ○ | Δ |
| Drawn filament | Fineness (denier) | | 68 | 67 | 66 | 68 | 67 |
| | Luster(Surface Gloss) | | ◎ | ◎ | ◎ | ○ | X |
| | Feel (Hand Feel) | | ◎ | ◎ | ◎ | ○ | Δ |
| | Flexibility (Finger-Wound method) | | ◎ | ◎ | ◎ | ◎ | ◎ |
| | strength (g/d) | | 1.50 | 1.52 | 1.57 | 1.62 | 1.65 |
| | Heat-Shrinkage Ratio (%, at 100° C.) | | 1.5 | 1.2 | 1.7 | 2.5 | 4.1 |

(*1): PVC[S1001] (M = 1000), a product of Kaneka Corporation
(*2): CPVC (Chlorine content = 64 wt %, M ≒ 800), a product of Kaneka Corporation
(*3): EVA Resin (EVA-Vinyl chloride graft copolymer)
(*4): Acrylate Processing Aid (Kaneace PA20), a product of Kaneka Corporation
(*5): Butyl Tin Maleate Thermal Stabilizer, a product of Sankyo Yuki Gosei Ink.
(*6): Butyl Tin Mercapto Thermal Stabilizer, a product of Sankyo Yuki Gosei Ink.

As is shown by comparison among Experiments 17–21, when the sectional area of a nozzle orifice is 0.5 $mm^2$ or less, various performances in spinning, performances in drawing and heating processes, and a fiber performance are highly balanced. On the other hand, when the sectional are of a nozzle orifice exceeds 0.5 $mm^2$, a luster of an drawn filament occurs to provide either a brilliant visual-feel or a smooth feel like plastic, thus lacking the sufficient quality as a product. Further, when the sectional area of a nozzle orifice decreases, the spinning draft ratio in melt spinning increases. As a result, there is a tendency that the frequency of filament-breakage upon drawing increases and heat shrinkage ratio of a fiber becomes high.

Experiments 22–26 (Effects of Fineness of Undrawn Filament)

As in the experiment 1–5, 100 parts by weight of vinyl chloride mixture was measured 4 kg. Each formulation ingredient shown in Table 8 was measured, and thrown into a 20-litter Henschel mixer, followed by stirring and mixing until the contents temperature reached 135° C. Thereafter, cooling water is caused to circulate within a jacket of Henschel mixer, while continuing stirring and mixing until the contents temperature is cooled to reach 75° C. to obtain a vinyl chloride powder compound. Incidentally, the EVA resins were prepared by graft-copolymerizing vinyl chloride with 35 wt % of vinyl acetate and vinyl chloride with melt index of 15 and adjusting an EVA content to 35 wt % for use. The powder compound was prepared into pellet compounds under the conditions shown in Table 7 (Pelleting conditions), and subjected to the melt spinning experiments.

TABLE 7

| Pelleting condition | |
|---|---|
| Extruder | 40 mmϕ Uniaxial Extruder. L/D = 22 |
| Screw | Full-flighted Type, Compression Ratio = 2.5 |
| Cylinder Temperature | C1 = 150° C., C2 = 155° C.<br>C3 = 160° C., C4 = 165° C. |
| Adapter Temperature | AD = 165° C. |
| Die Temperature | D1 = 170° C. |
| Cutting Condition | Hot Cut |

The pellet was subjected to melt spinning-, drawing-, and heat processing experiments according to the conditions similar to those shown in the experiments 1–5 for spinning, drawing, and thermal relaxation processing. At this stage, the take-off velocity was changed so that the each undrawn filament had its fineness as those shown in Table 8. Further, evaluations of the undrawn and drawn filaments were carried out in the same manner using as shown in the experiments 1–5 for experimental procedure and evaluation methods. The results evaluated are shown in Table 8.

TABLE 8

Effects of Fineness of Undrawn filament

| Experiment Number: Examples or Comparative Example | | | NO. 22 Example | NO. 23 Example | NO. 24 Example | NO. 25 Example | NO. 26 Comparative Example |
|---|---|---|---|---|---|---|---|
| PVC (*1) | | | 85 | 85 | 85 | 85 | 85 |
| CPVC (*2) | | | 15 | 15 | 15 | 15 | 15 |
| EVA Resin (*3) | | | 14 | 14 | 14 | 14 | 14 |
| Processing Aid (*4) | | | 2.1 | 2.1 | 2.1 | 2.1 | 2.1 |
| Tin Thermal Stabilizer (*5) | | | 0.5 | 0.5 | 0.5 | 0.5 | 0.5 |
| Tin Thermal Stabilizer (*6) | | | 0.5 | 0.5 | 0.5 | 0.5 | 0.5 |
| Calcium Stearate/Magnesium Stearate | | | 0.5/1.5 | 0.5/1.5 | 0.5/1.5 | 0.5/1.5 | 0.5/1.5 |
| Dipentaerythritol tetrastearate | | | 0.4 | 0.4 | 0.4 | 0.4 | 0.4 |
| Polyethylene Wax | | | 0.8 | 0.8 | 0.8 | 0.8 | 0.8 |
| Clay | | | 1.4 | 1.4 | 1.4 | 1.4 | 1.4 |
| at Melt spinning: | Nozzle Pressure ($Kg/cm^2$) | | 437 | 435 | 433 | 438 | 435 |
| | Resin Temperature (° C.) | | 187 | 187 | 186 | 186 | 187 |
| | Filament-Breakage Incidence | | ◎ | ◎ | ◎ | ◎ | ◎ |
| | Undrawn filament | Extruding amount (Kg/Hrs) | 7.10 | 7.10 | 7.10 | 7.10 | 7.10 |
| | | Fineness d (Denier) | 168 | 236 | 269 | 296 | 316 |
| | | Coloring | ◎ | ◎ | ◎ | ◎ | ◎ |
| Filament-breakage Incidence in Drawing-Heat Processing | | | ◎ | ◎ | ◎ | ○ | Δ |
| Drawn filament | Fineness (denier) | | 65 | 67 | 64 | 66 | 66 |
| | Luster(Surface Gloss) | | ◎ | ◎ | ◎ | ◎ | X |
| | Feel (Hand Feel) | | ◎ | ◎ | ◎ | ○ | Δ |
| | Flexibility (Finger-wound method) | | ◎ | ◎ | ◎ | ◎ | ◎ |
| | Strength (g/d) | | 1.51 | 1.52 | 1.53 | 1.55 | 1.56 |
| | Heat-Shrinkage Ratio (%, at 100° C.) | | 3.2 | 2.6 | 3.7 | 3.4 | 6.7 |

(*1): PVC [M1600] (M ≒ 1600), a product of Kaneka Corporation vinyl chloride-vinyl acetate copolymer resin (*2): CPVC (Chlorine content = 66 wt %, M ≒ 800), a product of Kaneka Corporation (*3): EVA Resin (EVA-vinyl chloride graft copolymer)

(*4): Acrylate Processing Aid (Kaneace PA20), a product of Kaneka Corporation (*5) Octyl Tin Maleate Thermal Stabilizer, a product of Sankyo Yuki Gosei Inc.

(*6) Butyl Tin Mercapto Thermal Stabilizer, a product of Sankyo Yuki Gosei Inc.

As is shown by the comparison among the experiments 22–26, when the fineness of an undrawn filament exceeds 300 denier, an excessive drawing is required in the drawing process to obtain an drawn filament with 65f- 70 denier. Therefore, in drawing process, not only the filament-breakage frequently occurs, but also an drawn filament feel becomes a slippery feel like plastics to provide luster, thus resulting in a poor quality as a product. On the other hand, when an undrawn filament has a fineness of 300 denier or less, the qualities thereof are highly balanced, thereby being capable of obtaining a fiber for artificial hair, having an excellent quality and being remarkably similar to the human hair.

Experiments 27–31 (Effects of Fineness of Drawn Filament)

100 parts by weight of vinyl chloride mixture was measured 4 kg. Thereafter, each formulation ingredient shown in Table 9 was measured, and thrown into a 20-litter Henschel mixer, followed by stirring and mixing until the contents temperature reached 115° C. Thereafter, cooling water is caused to circulate within a jacket of Henschel mixer, while continuing stirring and mixing until the contents temperature is cooled to reach 75° C. to obtain a vinyl chloride powder compound. Incidentally, the EVA resins were prepared by graft-copolymerizing vinyl chloride with 35 wt % of vinyl acetate and vinyl chloride with melt index of 10 and adjusting an EVA content to 35 wt % for use. The powder compound obtained was subjected to melt spinning-, drawing-, and heat-processing experiments under the conditions similar to those described in the experiments 1–5 as spinning, drawing, and thermal relaxation. At this stage, the drawing ratio was changed so that the each drawn filament had its fineness as those shown in Table 9. Further, evaluations of undrawn filaments and drawn filaments were carried out in the similar manner using the test procedures and evaluation methods shown in the experiments 1–5. The evaluation results are shown in Table 9.

TABLE 9

Effects of Fineness of Drawn Filament

| Experiment Number: Examples or Comparative Example | | | NO. 27 Example | NO. 28 Example | NO. 29 Example | NO. 30 Example | NO. 31 Comparative Example |
|---|---|---|---|---|---|---|---|
| PVC (*1) | | | 85 | 85 | 85 | 85 | 85 |
| CPVC (*2) | | | 15 | 15 | 15 | 15 | 15 |
| EVA Resin (*3) | | | 13 | 13 | 13 | 13 | 13 |
| Processing Aid (*4) | | | 1.5 | 1.5 | 1.5 | 1.5 | 1.5 |
| Tin Thermal Stabilizer (*5) | | | 0.5 | 0.5 | 0.5 | 0.5 | 0.5 |
| Tin Thermal Stabilizer (*6) | | | 0.5 | 0.5 | 0.5 | 0.5 | 0.5 |
| Calcium Stearate/ Magnesium Stearate | | | 0.5/1.5 | 0.5/1.5 | 0.5/1.5 | 0.5/1.5 | 0.5/1.5 |
| Stearyl alcohol/Montanonic acid wax | | | 0.5/0.5 | 0.5/0.5 | 0.5/0.5 | 0.5/0.5 | 0.5/0.5 |
| Polyethylene Wax | | | 0.6 | 0.6 | 0.6 | 0.6 | 0.6 |
| Talc | | | 0.8 | 0.8 | 0.8 | 0.8 | 0.8 |
| at Melt spinning: | Nozzle Pressure ($Kg/cm^2$) | | 425 | 429 | 423 | 421 | 423 |
| | Resin Temperature(° C.) | | 187 | 187 | 186 | 188 | 186 |
| | Filament-Breakage Incidence | | ⊙ | ⊙ | ⊙ | ⊙ | ⊙ |
| | Undrawn filament | Extruding amount (Kg/Hrs) | 425 | 429 | 423 | 421 | 423 |
| | | Fineness d (denier) | 187 | 187 | 186 | 188 | 186 |
| | | Coloring | ⊙ | ⊙ | ⊙ | ⊙ | ⊙ |
| Filament-breakage Incidence in Drawing-Heat Processing | | | ○ | ⊙ | ⊙ | ⊙ | ⊙ |
| Drawn filament | Fineness (denier) | | 55 | 64 | 76 | 96 | 106 |
| | Luster(Surface Gloss) | | ⊙ | ⊙ | ⊙ | ⊙ | ⊙ |
| | Feel (Hand Feel) | | ⊙ | ⊙ | ⊙ | ○ | Δ |
| | Flexibility (Finger-wound method) | | ⊙ | ⊙ | ⊙ | ○ | Δ |
| | Strength (g/d) | | 1.67 | 1.65 | 1.64 | 1.56 | 1.49 |
| | Heat-Shrinkage Ratio (%. at 100° C.) | | 3.3 | 3.6 | 3.1 | 3.7 | 3.2 |

(*1): PVC [S1001] (M = 1000) a product of Kaneka Corporation (*2): CPVC (Chlorine content = 67 wt %, M ≒ 600), a product of Kaneka Corporation (*3): EVA Resin (EVA-vinyl chloride graft copolymer)

(*4): Acrylate Processing Aid (Kaneace PA20), a product of Kaneka Corporation (*5) Butyl Tin Maleate Thermal Stabilizer, a product of Sankyo Yuki Gosei Inc.

(*6) Methyl Tin Mercapto Thermal Stabilizer, a product of Sankyo Yuki Gosei Co..

As is shown in Experiments 27–31, when the fineness of drawn filament exceeds 100 denier, the drawn filament has a rough and hard feels as well as a less flexibility, thus resulting in a poor quality as an artificial hair fiber. On the other hand, when the fineness of the drawn filament becomes 100 denier or less, the qualities thereof are highly balanced, thereby being capable of obtaining a fiber for artificial hair, having an excellent quality and being remarkably similar to the human hair.

As described above, the use of the vinyl chloride resin composition according to the present invention may provide the vinyl chloride fiber that has an excellent quality as well as a dry hand feel having seven-tenth to half of the full luster surface remarkably similar to human hair. Further, by employing the production process according to the present invention, it is possible to safely produce the vinyl chloride fiber of interest, while keeping a high spinning productivity. The vinyl chloride fibers of the present invention are advantageous for an artificial-hair fibers for the decoration of hair or fibers for dolls' hair such as doll-hair.

What is claimed is:

1. A fiber, comprising:

100 parts by weight of a vinyl chloride resin;

in the range of 1 to 35 parts by weight of ethylene-vinyl acetate resin;

in the range of 0.2 to 5.0 parts by weight of a thermal stabilizer; and in the range of 0.2 to 5.0 parts by weight of a lubricant;

said fiber having a fineness of less than or equal to 100 denier.

2. The fiber of claim 1, wherein the thermal stabilizer is selected from the group consisting of tin-thermal stabilizers, Ca—Zn thermal stabilizers, hydrotalcite thermal stabilizers, and zeolite thermal stabilizers.

3. The fiber of claim 1, wherein the thermal stabilizer is selected from the group consisting of tin mercapto thermal stabilizers, tin maleate thermal stabilizers and tin laurate thermal stabilizers.

4. The fiber of claim 1, wherein the lubricant is selected from the group consisting of metallic soap lubricants containing no cadmium or lead, polyethylene lubricants, higher fatty acid lubricants, pentaerythritol lubricants, higher alcoholic lubricants, and montanonic acid wax lubricants.

5. The fiber of claim 1, wherein said vinyl chloride resin is at least one resin selected from the group consisting of vinyl chloride homopolymer resins, ethylene-vinyl chloride copolymer resins, and vinyl acetate-vinyl chloride copolymer resins.

6. An artificial hair, comprising a plurality of the fiber of claim 1.

7. An artificial hair, comprising a plurality of the fiber of claim 2.

8. An artificial hair. comprising a plurality of the fiber of claim 3.

9. An artificial hair, comprising a plurality of the fiber of claim 4.

10. An artificial hair, comprising a plurality of the fiber of claim 5.

* * * * *